United States Patent [19]

Roessler

[11] 4,357,571

[45] Nov. 2, 1982

[54] FET MODULE WITH REFERENCE SOURCE CHARGEABLE MEMORY GATE

[75] Inventor: Bernward Roessler, Munich, Fed. Rep. of Germany

[73] Assignee: Siemens Aktiengesellschaft, Berlin & Munich, Fed. Rep. of Germany

[21] Appl. No.: 68,216

[22] Filed: Aug. 20, 1979

[30] Foreign Application Priority Data

Sep. 29, 1978 [DE] Fed. Rep. of Germany ..... 2842546

[51] Int. Cl.[3] ..... G05F 1/56; G05F 3/20

[52] U.S. Cl. ..... 323/281; 323/313; 323/314

[58] Field of Search ..... 323/19, 22 R, 273, 281, 323/313-317; 330/253, 296, 297; 307/238, 297, 238.8

[56] References Cited

U.S. PATENT DOCUMENTS

| | | | |
|---|---|---|---|
| Re. 27,668 | 6/1973 | Soltz et al. | 330/253 |
| 3,317,850 | 5/1967 | Hilbiber | 323/22 R |
| 3,469,112 | 9/1969 | Hands et al. | 330/253 X |
| 3,975,648 | 8/1976 | Tobey et al. | 323/22 R |
| 4,077,012 | 2/1978 | Iwamatsu | 330/253 |
| 4,087,795 | 5/1978 | Rossler | 307/238 X |
| 4,173,791 | 11/1979 | Bell | 307/238 X |
| 4,175,290 | 11/1979 | Harari | 307/238 X |

OTHER PUBLICATIONS

Hodges et al., "Potential of MOS Technologies for Analog Integrated Circuits", ESSCIRC 1977, Ulm 20, Sep. 22, 1977, pp. 43-47.

Roberge, Operational Amplifiers, John Wiley & Sons, 1975, pp. 452-455.

*Primary Examiner*—A. D. Pellinen

*Attorney, Agent, or Firm*—Hill, Van Santen, Steadman, Chiara & Simpson

[57] ABSTRACT

The exemplary embodiments concern reference sources for A/D and D/A converters, for example of a PCM telephone exchange system. Two separated stages which are supplied however from the same direct current supply source, contain in each case the series circuiting of at least one IG-FET and at least one load resistor. Between the taps of the stages, a differential voltage appears, which is used itself directly as a reference voltage, or indirectly is used for the setting of the value of a reference voltage, or of a reference current, for example by a voltage divider. The value of the reference voltage, or of the reference current, is also exactly adjustable after production of integrated modules, because in at least one of the two stages, at least one of the IG-FETs contains a memory gate which is at least partially applied between the controllable control gate and the channel area, is on all sides surrounded by an insulator, and thus is floating in the electrical sense.

6 Claims, 6 Drawing Figures

J1
J2

R1
R2
DV
U3/J3
RS
U1
F1
F2
U2
U10
U20

VDD
R1
R2
RS
DV
U3/J3
A3
i1
i2
A1
A5
A4
F1
F2
U1
U2
A2
R0
VSS

UE
(VOLTS)
18
16
14
12
10
8
6
4
2
0
VDS
25V
0V
t
VDS=
22.5V
15V=VDS
17.5V=VDS
20V=VDS
10^-3
10^-2
10^-1
1
10^1
10^2
t
(SECONDS)

FET MODULE WITH REFERENCE SOURCE CHARGEABLE MEMORY GATE

BACKGROUND OF THE INVENTION

The invention concerns an electronic arrangement, namely, a special reference source, which yields a reference voltage, or a reference current of defined magnitude. The invention was developed in particular in n-channel technology for the feeding of the R/2R-networks of D/A converters, that is, PCM/AM decoders, and above all, of A/D converters, that is, AM/PCM coders, in particular also for charge-to-voltage, as well as for voltage-to-charge converters of CCD filters of a special PCM telephone exchange system which is constructed out of highly integrated modules. In such an application, the reference sources, R/2R-networks, other converter elements and also the filter are located on the same FET module. The invention is suited however, above and beyond this for various FET modules, which require a substantially exactly adjustable reference voltage, or a subsequently very exactly adjustable reference current.

The invention proceeds from a reference source on an integrated FED module, whereby

- two separated levels which are however supplied by the same direct current source, in each case contain series circuiting of at least a IG-FET and at least one load resistor,
- in each case a tap is applied between one of the IG-FETs and one of the load resistors in each stage, and
- between the taps of the stages, a difference voltage of defined value appears, which is used directly as a reference voltage, or which indirectly is used for the adjustment of the value of a reference voltage, or respectively, of a reference current, for example, by means of a bleeder.

Such a reference source is already specified in ESSCIRC (European Solid State Circuitry Conference) 1977, Ulm. Sept. 20–22, 1977, Digest of invited papers and contribution papers, pages 43 through 47, in particular page 44, right column, second to last paragraph. It is also encouraged to construct the IG-FETs of both stages differently, namely, on the one side with a depletion type channel area, on the other side with an enhancement type channel area, in order to utilize their different threshold voltages. There, however, finally also the necessity is pointed out that first development efforts are still necessary before a reference source for an integrated module is found which is also usable. The divergences of characteristics because of the unavoidable tolerances in the case of the production are in this case apparently very inconvenient. In particular, the applying of different channel area types in the two stages has as a result inconveniently difficult problems with respect to the tolerances which are bound up with this.

SUMMARY OF THE INVENTION

The invention solves these difficulties, or respectively, the production tolerances in the case of the use of IG-FETs, which is particular already because of these production tolerances display different characteristics, by this, that in the case of the invention, after the production of the module subsequently, in an easily executable manner, the magnitude of the reference voltage, or respectively, of the reference current, is to be essentially continuously adjustable over a wide range, with any selected setting being essentially permanently retained (until deliberately changed).

The IG-FETs of the respective stages, according to the invention, can display randomly in each case a p-channel of an n-channel, and indeed, randomly of the depletion type or the enhancement type. The channel area can also be $p^+$ doped in the case of p-channel or in the case of n-channel can also be $n^+$ doped, thus can represent an "Inhibiting type" channel area, which has a strongly elevated control gate/source-threshold voltage (control gate to source threshold voltage or cut-off voltage), in the case of which a source-drain current begins to flow. The construction of the IG-FETs, and also the construction of the controlling circuit of these IG-FETs is thus in the case of the invention not limited to one single special variant, so that the area of application of the invention is correspondingly large.

The invention does not necessarily have as a prerequisite the use of the measures which display balancing effects and which are known, as for example, a subsequent radiation with highly energetic particles, a heating up for the changing of the doping profile, or a point-by-point processing with a laser. In the case of tube circuits, such a subsequent balancing would be known to be relatively easy to carry out by means of exchange of resistors, by means of single turn potentiometers, etc., in the circuit controlling the tube. In the case of integrated modules one can, as is known, also supply adjustable components outside of the module subsequently for the balancing, which represents an inelegant balancing measure which requires space. In the case of the invention, thus, the balancing is carried out neither outside of the module, nor within the operating circuits associated with the IG-FETs.

The invention in fact permits, in the case of first too strong balancing by accident, the random weakening entirely or partially of this measure, until the balance with the desired strength, or respectively, precision is attained. The balancing can thus be carried out reversably and repeatedly by means of certain balancing measures, and when necessary can be balanced again into another state.

Already known through a great number of documents, for example, through the U.S. Pat. No. 4,087,705 issued May 2, 1978, is a special IG-FET with source, channel area, drain, insulator and controllable control gate, which is used for the storing of signals, which contains additionally, for the making possible of the storing of the signal, a conducting memory gate which is surrounded on all sides by the insulator between its control gate and channel area. By means of charge reloading, the threshold voltage and the source-drain-current/control gate - source - characteristic are displaced, dependent upon the dimension and the polarity of the charge reloading more or less to positive or negative voltage values. Such memory gates are charge reloadable, for example in the case of an n-channel through electrons which are heated up in the conducting channel area by means of an accelerating source-drain voltage, thus are reloadable by means of the so-called channel injection. The memory gate can also be charge reloaded by means of charges which are heated up and produced at the inhibiting channel area—drain junction, that is by means of the avalanche effect. The memory gate can also be charge reloaded by charges heated up at the channel area surface by means of voltage pulses, also by means of charges heated up at the memory gate surface by means of voltage pulses. The memory gate is further charge reloaded by the Fowler-Nordheim tunnel effect, as well as by non-electrical measures, for example, by means of irradiation with light. All of these measures for the reloading of charge, that is, charging or discharging of the memory gate, are known in the case of such IG-FETs with memory gate through a multiplicity of documents. Also known is the charging of the memory gates by means of one of these effects and by means of another of these effects to again discharge. These effects are proposed for the displacement of the operating point, or respectively, of the characteristic of an IG-FET amplification stage operated with alternating signals with memory gate in the German Application P 28,42,631.5, which was filed at the same time as the priority document on which the present application is based.

For example, the use of such IG-FETs with memory gate as analog signal memory is known through Proc. 5th Conference on Solid State Devices., Tokyo/Supplement to J. Japan Society of Applied Physics 43 (1974), pages 348 to 355, in particular page 354, paragraph 5, as well as through *Electronics,* July 11, 1974, pages 29/30. Also, the memory gate is discharged proportionally to the analog amplitude of the signal to be stored, whereby later this stored analog amplitude is again read out, whereby the read out signal displays an analog amplitude which corresponds to the stored analog signal.

The invention thus proceeds from a reference source on an integrated FET module, whereby:

- two separated stages, which, however, are fed by the same direct current supply source, in each case contain the series circuiting of at least one IG-FET and at least one load resistor;
- in each case, a tap is applied between one of the IG-FETs and one of the load resistors in each stage; and
- between the taps of the stages, a differential voltage of defined value occurs, which is used directly itself as the reference voltage, or which is used indirectly for the setting of the value of a reference voltage, or respectively, of a reference current, for example, by means of a voltage divider.

The above mentioned problem of the invention is solved thereby that: in at least one of the two stages, at least one of the IG-FETs contains a memory gate which is applied at least partially between the controllable control gate and the channel area, is surrounded on all sides by an insulator, and thus is suspended in the electrical sense.

The reference source is less sensitive to fluctuations of the direct current supply voltage if the parallel circuiting of both stages lies in series to a high—ohm emitter—follower resistor.

Without considering other components on the module, such an IG-FET of the inventive reference source can be balanced when the electrodes of this IG-FET which contains the memory gate is connected with its own connections, for example, with aluminum specks, of the integrated module, which are accessible after the production of the IG-FET, at least before the encapsulation of the module.

The level, that is, the potentials, as well as also when necessary the amplitude of the differential voltage can be changed thereby, that each of the two inputs of a differential amplifier in each case is connected with the tap of a respective stage. In particular, such a reference source can be used basically both as reference voltage source as well as reference current source according to the selectable output internal resistance of the differential amplifier. It can be used in particular as reference voltage source if an output of the differential amplifier is connected with a first voltage divider, the tap of which is connected with the control gate of one of the IG-FETs of the first of the two stages. It can be used in particular as reference current source if an output of the differential amplifier is connected with the first voltage divider, the tap of which is connected with the control gate of at least one of the IF-FETs of the first of the two levels, the same output of the differential amplifier is connected with a second voltage divider, the first divider member of which is connected directly with the output of a differential amplifier and the other divider member of which represents the load resistor to be delivered with the reference current, and the tap of the second voltage divider is connected with a third voltage divider, the tap of which for its part is connected with the control gate of at least one of the IG-FETs of the second stage.

The reference source delivers not only constant voltages, or respectively, constant amplitude direct currents, but also constant amplitude alternating voltages, or respectively, currents, with subsequently balanced operating point if at least one of the IG-FETs, and/or at least one of the resistors connected with it, of the two stages is connected with a control input for the overlaying of a controlling alternating signal. Thereby, the reference source namely becomes controllable at the control input, whereby for example, the direct currents, or respectively, constant voltages, can be circuited in and out, when a binary alternating signal is directed to the control input. The direct currents, or respectively, constant voltages, can also be modulated with analog signals when an analog alternating signal is directed to the control input.

The invention and its further developments are explained further with the use of the exemplary embodiments shown on the accompanying sheets of drawings; and other objects, features and advantages will be apparent from this detailed disclosure and from the appended claims.

DETAILED DESCRIPTION

Figure 1:
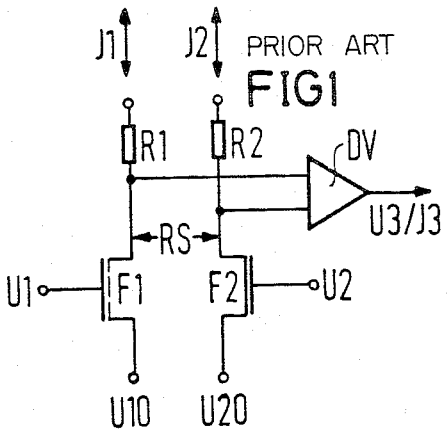
PRIOR ART FIG1
FIG. 1 shows schematically the reference element inspired by the above cited ESSCIRC document.

FIG. 1 shows that based on the ESSCIRC document, the use of two IG-FETs with different channel area types is inspired, which apparently in each case should display a load resistor R1, R2. In the case of loading with the currents J1, J2 of the direct current supply source, between the taps there occurs a differential voltage RS which can be used in particular directly as the output reference voltage. In the ESSCIRC document it is not explained in detail how this differential voltage RS is used. It would be conceivable, for example, to use the level change, perhaps also amplification, by means of a differential amplifier DV, in order to only indirectly use its output signals U3/J3 (U3 and/or J3) as references. In ESSCIRC, also nothing is reported concerning the voltage values for U1, U2, U10, U20. One can however proceed from this, that there, constant potentials, for example, earth (ground potential) or other constant operating voltages apply, which control the IG-FETs F1, F2 in their conducting state, so that because of the difference of their channel area types, namely, depletion type and enhancement type, at the taps, or respectively, at the inputs of the differential amplifier DV, a differential voltage RS which corresponds to the desired reference voltage U3 or respectively, the desired reference current J3 appears. The production of such IG-FETs F1, F2 however demand very narrow, barely maintainable production tolerances, in order to really be able to use such an arrangement as a reference source.

Figure 2:
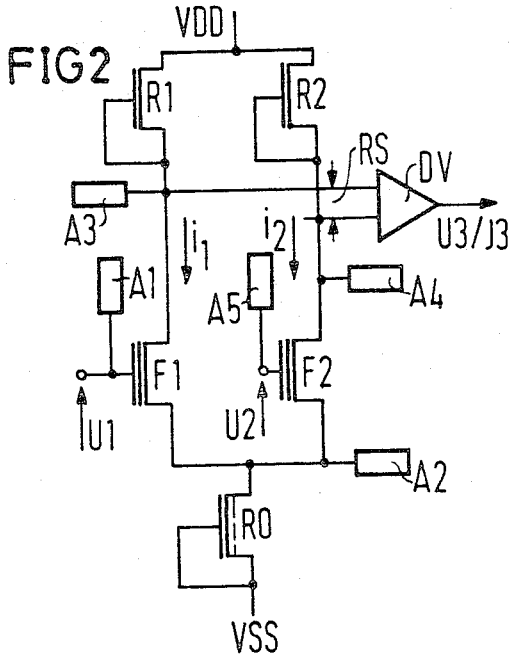
FIG. 2 shows an example of the invention which is stabilized against direct current supply variations and against temperature variations.

According to the invention, this difficulty is done away with, when at least one of the IG-FETs, for example F1, displays between its control gate and the channel area, a memory gate which is floating in the electrical sense, as is shown in FIG. 2. This memory gate is, after the production of the module, subsequently selectively chargeable, or respectively, dischargeable, more or less positively or negatively, thus is charge reloadable or charge adjustable and thereby, the characteristic and the threshold voltage of the pertaining IG-FET is randomly displaceable over an essentially continuous range of values. The pertaining IG-FET is thus similarly operated to the IG-FET with memory gate used as analog signal memory which is specified for example by *Electronics,* July 11, 1974, pages 29/30. In the case of the invention, a pertaining IG-FET or the pertaining IG-FETs with memory gate F1, F2 (FIG. 2) however serve not only for writing in, storing and reading of analog signals, but also for the stepless adjustment (i.e. selection from an essentially continuous range of values) of the constant operating point of the total reference source, in order to compensate for the errors of the reference voltage, or respectively, of the reference current, which necessarily occur in the first instance because of the unavoidable production tolerances of so complicated a reference source. In order to reload or adjust the charge of the memory gate, so that the remaining components of the module are protected, one can connect the electrode of the pertaining IG-FET, compare the control gates, sources and drains of the IG-FETs with memory gate F1, F2 in FIG. 2, in each case directly with its own connection of the module, for example with the aluminum specks A1, A2, A3 for F1 and A5, A2, A4 for F2. These connections, which should still be accessible after the production of the pertaining IG-FET, can for example, by touching with voltage directing tips, be supplied with such voltages, which carry out the charge adjustment of the memory gate, and with this, the exact balancing (adjustment) of the reference voltage, or respectively, of the reference current, for example, RS or U3/J3. The differential amplifier DV thus delivers the reference values U3, or respectively, J3 with the polarity and magnitude which are adjustable according to need, when the polarity and magnitude of the differential voltage RS after the production of the reference source subsequently can be continuously adjusted over a given range (without steps or discontinuities in such adjustment range) on the module, for example, to 1 mV exactly, when the values of the loading currents i1, i2, can be subsequently adjusted by the charge adjustment of the memory gate of the IG-FETs, F1, F2 (FIG. 2) randomly according to need.

The example shown in FIG. 2 differs from the example shown in FIG. 1 also in that the potentials corresponding to U10, U20 in FIG. 1 are equally large for both IG-FET F1, F2 (FIG. 2), and in that both stages F1/R1 and F2/R2 are connected with one another there conductively (and also with conductive region A2). Beside this, at this parallel circuiting of the stages F1/R1, F2/R2 in FIG. 2. a particularly high—ohm emitter—follower resistor R0 is connected on, in relation to which the load resistors R1, R2 of FIG. 2 display comparatively a markedly smaller resistance value—the resistance values being attainable in a manner which is essentially known, for example, by the selection in each case of the length/width relationship of the channel area of these FETs which are operated with two poles as resistors. The emitter-follower resistor R0 permits stabilizing of the total current i1+i2 of the stages which are supplied by the direct current supply source VDD/VSS against fluctuations of the direct current supply, so that the differential voltage RS and thus also U3/J3 is correspondingly independent of the magnitude in each case of the voltage VDD/VSS (i.e. correspondingly independent of fluctuations in the potential difference between VDD and VSS).

In the case of all these charge adjustments, a partial unloading of a previously positively loaded memory gate of an IG-FET F1, F2 in FIG. 2 corresponds to a negative loading. Also, a partial unloading of a previously negatively loaded memory gate corresponds to a positive loading. Since one can carry out the different balancing measures, that is, charge adjustment measures, essentially also one after the other in the case of the same IG-FET, all balancings are reversible, that is, in the case of an erroneously too strong balancing measure, such charging step is later randomly revisable, in that the memory gate which is loaded erroneously too strongly or too weakly or with the wrong polarity can be charge adjusted later randomly again, in order to correct the balance.

Because the pertaining IG-FET F1 and/or F2 in FIG. 2 displays a memory gate, its characteristic does not depend only upon the originally present channel region type (enhancement type, depletion type, inhibiting type), but rather also on the subsequent charging of the memory gate: If the memory gate is uncharged, then in principle, the original characteristic applies further, as if no memory gate were present, always according to whether the channel region is of the depletion type, enhancement type or inhibiting type.

If on the other hand, its memory gate was subsequently charged, then it has no longer the original characteristic, although it, for example, displays an enhancement type channel region, but rather has a displaced characteristic, as if it had a correspondingly different channel region.

If namely the memory gate is loaded with majority charge carries of the source or of the drain, thus with holes in the case of p-channel, or respectively, with electrons in the case of n-channel, then already because of this memory gate charge alone, such a first displacement of the characteristic takes place as if it now had an inhibiting type channel region, although it has an enhancement type channel region. For controlling of the IG-FET in its conducting state, namely, first the effect of the charging of the memory gate which rejects such majority charge carriers in the channel region K must be compensated by means of the control gate, before a channel can form between the source and the drain.

If on the other hand the memory gate is loaded with minority charge carriers of the source or of the drain, thus with electrons in the case of p-channel, or respectively, with holes in the case of n-channel, then already because of this memory gate charging alone, an opposing displacememt of the characteristic takes place, as if it now had a depletion type channel region, although it has an enhancement type channel region. For controlling of the IG-FET in its conducting state, namely, the effect of this charging, which enhances the majority charge carrier in the channel region K, need not first be produced by means of the control gate in order to obtain a conducting channel between the source and the drain.

If however, the IG-FET has a channel region doping, which already in itself corresponds to a depletion type, then one can also by means of the subsequent loading of its memory gate with the majority charge carriers, attain the first displacement of the characteristic, as if now the IG-FET had for example an enhancement type or inhibiting type channel region; or, by subsequent loading with the minority charge carriers, also can achieve the opposing displacement of the characteristic, as if it had an even more strongly doped depletion type channel region.

If the IG-FET nevertheless originally has a channel region doping which corresponds already to an inhibiting type, then through the subsequent loading with majority charge carriers, one can attain again the first displacement, and by subsequent loading with the minority charge carriers one can again attain the opposed displacement of the characteristic.

By means of the subsequent loading of the memory gate with the corresponding charges, one can thus attain a displacement of the characteristic randomly to the left and to the right, whereby, depending upon the strength of the charging, the displacement is strong or only weak.

Figure 3:
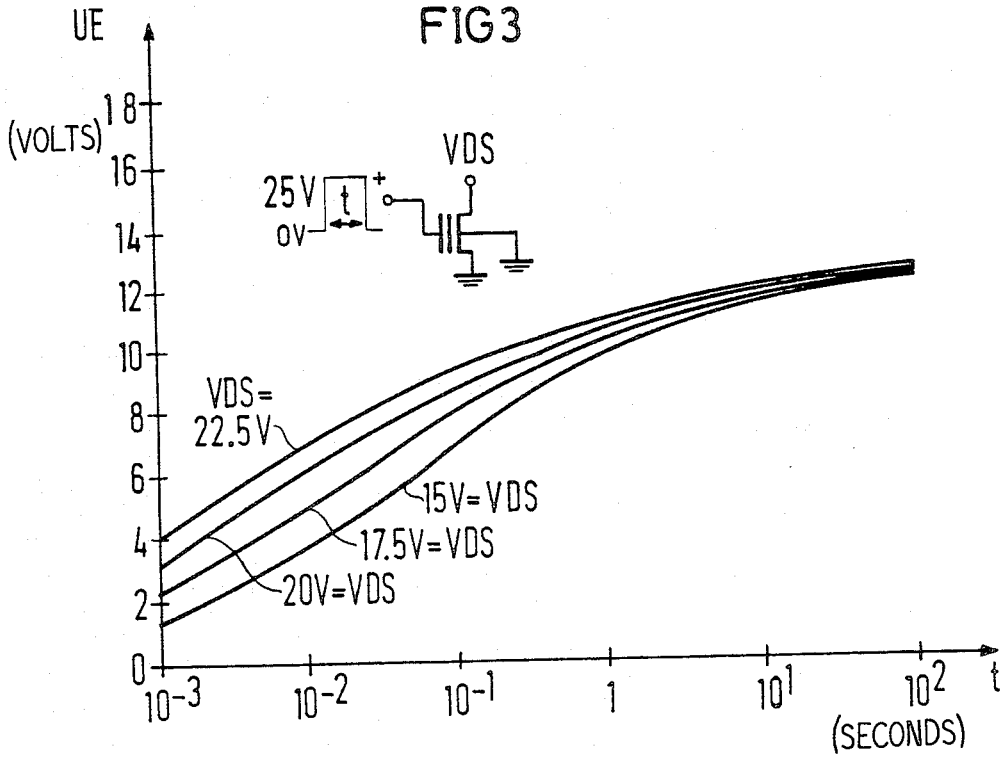
FIG. 3 shows a diagram plotting threshold voltage as a function of loading duration as an example for illustrating the influences of time and of drain bias voltages during charge loading by means of the channel injection.

FIG. 3 shows an example of essentially continuous charging or respectively, of the corresponding effect of the balancing measures on the characteristic, or respectively, on the threshold value UE, in the case where a noticeable source-drain current begins to flow. FIG. 3 shows the characteristics of an n-channel IG-FET with six micron (62 $\mu$m) long channel region, the memory gate of which, during time durations t which last for different lengths, proceeding in each case from the deloaded (uncharged) state by means of channel injection is negatively charged. The source-drain voltages VDS, which are applied during the balancing, amount to 15 V, 17.5 V, 20 V and 22.5 V. The control gate-source voltage amounts to 25 V during the balancing. The curves show that the threshold voltage UE, dependent in particular upon the duration t, rises as a result of the balancing procedure, whereby a limit value of approximately 13 to 14 V is recognizable, which in particular depends upon the control gate—source voltages used and, in the case of long durations of several minutes, is to a large extent attained. In all cases, a slight rise in the ordinate values UE of the threshold voltage curves by the order of magnitude of tenths of a volt is still recognizable between t=10 seconds and t=100 seconds, so that the limit value actually is fully attained only after hours and days.

In the case of the state which is close to the limit value recognizable in FIG. 3, for example, after one second, the memory gate is found finally at a potential of approximately minus ten volts (−10V) in the case of a voltage at VDS, FIG. 3, of zero volts (VDS=0 V), and in the case of source potential at the control gate. This memory gate potential results if one draws off the threshold voltage displacement of approximately twelve volts (12 V) from the control gate—source voltage of twenty-five volts (25 V) and one takes into account the capacitive voltage division between control gate, memory gate, source, channel region and drain.

In case of this IG-FET, also dependent upon the channel region length, with a control gate—source voltage of 25 V, already in 100 m sec a threshold voltage rise of approximately 5 to 10 V is possible. For a subsequently carried out balancing on the module however, often only threshold voltage changes of for example 20 mV are necessary. If in the case of balancing, control gate voltage pulses of for example only 12 V are used, whereby the memory gate is found in the unloaded state because of the capacitive voltage division at a potential of approximately +10 V, then there results, in the case of use of pulse durations of one millisecond (1 msec), threshold voltage displacements often far under one millivolt per pulse (1 mV per pulse). In the case of pulse durations far under one millisecond (1 msec), one obtains where needed still lower threshold voltage displacements, even if the memory gate potential is in the meantime somewhat charged.

Also by following a procedure wherein the peak value of the control gate voltage pulse is raised from pulse to pulse by for example, 10 mV, a threshold voltage displacement can be carried out with a sufficient exactness in a short time.

The loading (charging) is ended if, in the case of inputs which are customary for the use as reference sources, for example grounded inputs U1, U2, at the output of the differential amplifier, the desired reference voltage of for example U3=OV or U3=XV is measured. This measuring can in each case be carried out between the individual control gate voltage pulses.

The strength of the loading can thus be randomly be chosen by means of a corresponding selection of the amplitudes and/or durations of the balancing measures which are used for the loading—compare the known use of such an IG-FET as analog signal memory. Thus, the characteristic can be displaced by random values over an essentially continuous range, thus not only by a fixed value, and the differential voltage RS can be set randomly over an essentially continuous range according to polarity and amount. Since some of the balancing measures display the characteristic in a positive, and others in a negative direction, the memory gate can be charge adjusted essentially over a continuous range almost at random, also reversably several times alternatingly in positive and negative direction, and indeed can be randomly loaded and partially or entirely again deloaded—in particular with the use of the above named reloading (charge adjustment) measures which are known in the case of IG-FETs with memory gates, which here represent balancing measures, or respectively balancing voltages. When necessary for the balancing, one needs only to apply the voltages necessary for the reloading (charge adjustment) at the electrodes of the IG-FET momentarily, until finally the desired balance is attained.

The balancing voltages can be fed to in each case the pertaining IG-FET, for example F1 (FIG. 1), for example, in the case of the disk testing, or respectively, during the testing of the finished chip, by means of peaks via aluminum specks which are provided for this, that is, via connections of the chip which are specially applied for this. In particular, in order not to subsequently influence other components applied upon the integrated module, one can connect all or only a part of the electrodes of the IG-FET which contains the memory gate G1 directly with the aluminum specks, via which the balancing voltages can be conducted directly to this IG-FET, compare, the aluminum specks A1/A2/A3 for F1 and A5/A2/A4 for F2 in FIG. 2. It is however, also possible to provide corresponding housing connections, which make possible a balancing also after the installation in the housing.

It is also possible to conduct a preliminary coarse, thus inexact, balancing already on the disk, or respectively, on the chip, and to carry out the final fine balancing only after the installation in the housing, for example, with the use of a UV light radiation by means of a quartz window. If hereby a UV laser is used, then the balancing can be carried out in few milliseconds, compare for example, IEEE-Trans. on ED, Volume ED-24 (1977) No. 2, page 159.

Often it suffices to reload (charge adjust) in each case according to the operational sign of the error of the differential voltage to be balanced, only the one IG-FET F1 or the other IG-FET F2, FIG. 2.

The IG-FETs with memory gates can for example, be realized with the known double silicon N-channel technology, compare for example German O.S. No. 24,45,030.

For large amplification of the stages, often a large width/length relationship of the channel region is practical, of for example 35, which is also possible in the case of IG-FETs with memory gate, compare also IEEE-J. of Solid State Circuitry, SC-11 (December, 1976) pages 748–753.

The differential voltage RS arises by nonagreement (dissimilarity) of the two stages F1/R1, F2/R2, FIG. 2, in particular because of the different geometries, dopings and loadings of the IG-FETs F1, F2, which also effect different currents i1 and i2 for $U_1=U_2$. In order for example, to make RS=0, for example $U1+\Delta U=U2$ could be placed at the input U2. In the case of the invention, instead of applying $\Delta U+U1=U2$, in the case of U1=U2, a corresponding loading (charging) can be carried out at least of one of the memory gates, in order to make RS=OV. Such a balancing is for example useful when the differential amplifier DV delivers a reference magnitude U3, or respectively J3, which because of the dimensioning of all components can be maintained approximately at RS=0. In this case, both stages are dimensioned as equally as possible.

Because of the relatively small channel dimensions, in particular, with respect to the channel length, the nonagreement of the stages which is obtained then nevertheless at first is caused above all through the photo lithographic fluctuations, that is, tolerances, of the structure width, or respectively, of the remaining geometrical dimensions, as well as of the doping intensities. The fluctuations in particular of the oxide thickness of the border surfaces loadings, and with this also the threshold voltage, are less if the two stages R1/F1, R2/F2 (FIG. 2) are applied closely next to one another on the module. The reloadings (charge adjustments) of the memory gate which are necessary for the balancing are correspondingly slight.

In the case of carefully applied insulation, the long time storage behaviour of the IG-FETs with memory gate is good. Because of the loadings (charge levels), which are often only very slight, and which are necessary for the balancing, the field strengths in the IG-FETs of both levels are similar to one another. Therefore, a later undesired reloading (charge adjustment) in the later operation of the reference source is in general no longer to be expected, as long as the source-drain voltages or respectively control gate—source voltages in the operating of the reference source remain at least approximately 5 V under those values in the case of which a charge loading or unloading of the memory gate would set in noticeably after one minute, compare FIG. 3.

Something similar applies, if a differential voltage RS is to be adjusted which strongly deviates from zero. One obtains a certain still insufficient balance for example, if one selects the width/length relationship of the channel regions of the IG-FETs of both levels correspondingly different, so that now only a fine balance is necessary by means of the loading (charging) of at least one of the memory gates. The tolerances of the threshold voltages of the IG-FETs almost always make a certain balancing necessary, if only a small tolerance of the reference voltage, or respectively, reference current is admitted. Because of the different voltage dependencies and because of the different temperature dependencies of depletion type and enhancement type FETs, the attainable tolerance of the reference voltage, or respectively, of the reference current would often be much too large, if one should use the known reference source of FIG. 1. Here, the invention can however admit smaller tolerances.

In the case of the invention, compare FIG. 2, thus the threshold voltage at least of one of the two IG-FETs F1, F2 can be decreased or raised as needed and thus a desired reference magnitude, for example, RS, U3, J3, can be set exactly and long-lastingly. In FIG. 2, all FETs are embodied as depletion type FETs. However, also an embodiment of the FETs is possible for example as enhancement- FET or inhibiting type FET. Also a CMOS technology is possible in which the operating resistors R1, R2 display an oppositely doped channel region in comparison to the IG-FETs F1, F2. The constancy of the reference magnitudes is, opposite the reference source in FIG. 1, noticeably improved, since as needed the two IG-FETs F1, F2 of the stages, with the exception of the different loadings of the memory gate, can have nearly the same characteristics among themselves. With the use of FIG. 4, it is to be shown namely with an example that despite the same geometries and the same dopings of both stages, also without loading, a differential voltage RS which strongly deviates from zero is attainable, so that subsequently only a fine balancing by means of reloading (charge adjustment) is necessary.

Figure 4:
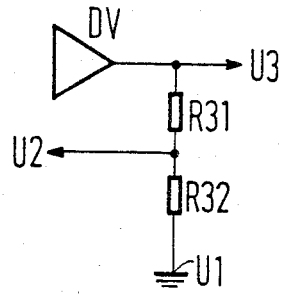
FIG. 4 shows details of an example according to the invention of a reference voltage source.

FIG. 4 shows details of a variant of the example shown in FIG. 2, which in particular can be used as a reference voltage source. At the output of the differential amplifier DV, a voltage divider R31/R32 is installed, in order to conduct a bias voltage U2 to the control gate of one of the IG-FETs for example F2 in FIG. 2, which bias voltage, strongly differs from the bias voltage U1, for example earth, of the control gate of the other IG-FET F1 (FIG. 2). In this manner, the reference voltage U3 which is delivered in this example by the differential amplifier DV, which reference voltage comparatively may be very large, is also used for the production of the bias voltage U2 in FIG. 2. The feeding of the bias voltages U1, U2 which differ among themselves, to the indicated control gates in FIG. 2, that is, a corresponding dimensioning of the voltage divider R31/R32, thus permits the attaining of the desired subsequent balancing of the levels with particularly slight reloading (charge adjustment) of the memory gate even when RS, or respectively U3 is very large.

It is nevertheless also possible in the case of U2=U1, to attain a subsequent balancing for very large RS or respectively U3, without applying the voltage divider R31/R32 which is shown in FIG. 4, and without constructing the stages F1/R1, F2/R2 differently among one another. One can namely in the case of balancing also attain very high positive or negative loadings of the memory gate by means of correspondingly large and correspondingly long-sustained balancing measures, for example, a loading to +10 V, whereby the threshold voltage, or respectively, the differential voltage RS nevertheless can be adjusted very precisely, for example, to exactly 1 mV. This variant is particularly to be recommended when the value of the reference size to be finally set in the case of the production of the module is not yet known, and when the once set loading of the memory gate is not necessarily supposed to remain on the memory gate with the same exactness over a very long time, for example, over many years. The sligher the loading is, the longer the time is in which the loading remains with the adjusted exactness on the memory gate.

The exactness of the setting of the loading is particularly large if to the IG-FET with memory gate F1, a further IG-FET is parallelly circuited in the same stage. The loading of the IG-FET with memory gate F1 then has only very small influence on the resulting threshold voltage of this parallel circuiting, particularly if F1 has a relatively small width/length relationship of its channel region in comparison to the parallelly circuited IG-FET. Exactly in accord with this, to 0.1 mV, one can however easily set the resulting threshold voltage of the parallel circuit at the balancing.

If in the case of these last specified variants, both IG-FETs of the parallel circuit display their own memory gate, whereby additionally a separated activating possibility for the control gate of both IG-FETs, for example, by means of their own aluminum specks and by for example installing a switch in the connection between the two control gates of these two IG-FETs, then one can balance both IG-FETs separately from one another. Thus, one can displace the resulting characteristic of the parallel circuit of these two IG-FETs randomly strongly in positive and negative direction. In the case of this further design, one can also select the relationship of the channel length to the channel width in the first of these two IG-FETs to be comparatively small and, in the case of the second of these two IG-FETs, comparatively large. In the case of these special variants one can first balance the first IG-FET coarsely such that the resulting characteristic of the parallel circuit has approximately the desired course. Following this, one can, by a balancing of the second IG-FET, quickly and easily attain a precise fine balancing, since its balancing itself in the case of relatively strong reloading (charge adjustment) of its memory gate has only a small influence on the resulting characteristic of the parallel circuit.

For a PCM coder and decoder with R-2R-network, often a reference current source is necessary which in particular can be operated with a load resistor RL which lies on the one side at earth potential. FIG. 6 shows an example constructed according to the invention, which was developed with the use of the reference current source example which was shown in FIG. 5. Also, an output of the differential amplifier DV is connected with a first voltage divider KR/KR, the tap of which is connected with the control gate of at least one of the IG-FETs, here F1, FIG. 6, of the first of the two stages F1/R1. The same output of the differential amplifier DV is connected with a second voltage divider $\alpha R/RL$, FIG. 6, the first divider member $\alpha R$ of which is connected directly with the output of the differential amplifier DV and the other divider member RL of which represents the load resistor RL to be delivered with the reference current I3, whereby the tap of the second voltage divider is connected with a third voltage divider $(1-\alpha)\cdot R/R$, the tap of which for its part is connected with the control gate of at least one of the IG-FETs, here F2, FIG. 6, of the second stage F2/R2, FIG. 6.

Figure 5:
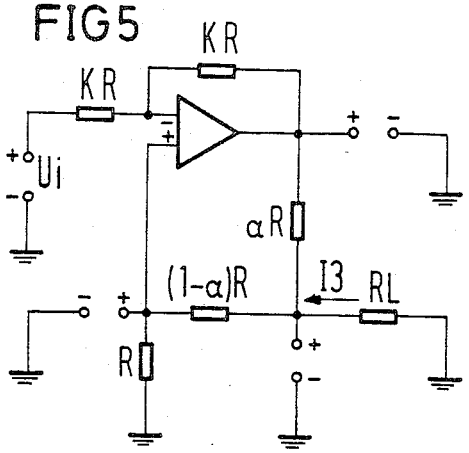
PRIOR ART FIG5
FIG. 5 shows a known example of a reference current source.
Figure 6:
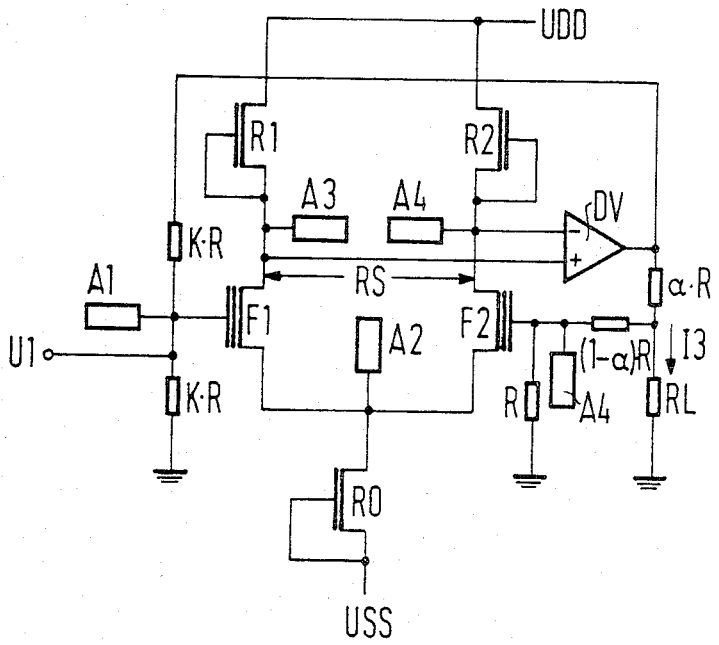
FIG. 6 shows the example from FIG. 5 further developed according to the teachings of the invention.

FIG. 5 namely shows the circuiting of a reference current source, which is kniown under the designation "Howland Current Source", compare Roberge, *Operational Amplifier*, 1975, pages 452 through 455. The current I3 through the load resistor RL in the case of the dimensioning selected there is $$I3 = Ui\cdot(1/\alpha R)$$

The current source characteristic with infinite output side internal resistor demands for this for example, the resistance relationships which are entered in FIG. 6, whereby the factors K and $\alpha$ can actually be random. The sufficient maintaining of such a dimensioning in the production of the reference current source as part of an integrated module causes relatively few difficulties. The absolute value of the resistance R, which also determines I3, if it is embodied as a polysilicon track or as diffusion track, is relatively constant. However, it still displays the production condition fluctuations, or respectively, tolerances. For this reason, the reference current I3 should still be adjusted exactly via the reference voltage Ui; thus, should be balanced. For this, for example, the construction according to the invention according to FIG. 6 can be chosen. Instead of the reference voltage Ui, in the case of the invention, for the adjustment of the reference current I3, the balancable stage F1/R1, or respectively F2/R2, FIG. 6, is used, whereby their differential voltage RS can be balanced exactly in the manner described above according to need subsequently on the manufactured module. The balancing of the reference current I3 can in particular be carried out through a suited number of balancing voltage pulses, which effect the threshold voltage displacement. In fact, a reference current source with reversed current direction −I3 can in particular be carried out by means of operational sign exchange of RS, or respectively of the threshold voltage displacement. In this case for example, the other IG-FET F2

(FIG. 6) instead of the IG-FET F1 (FIG. 6) can be loaded.

A reference source which is constructed according to the invention in operation can deliver the constant reference magnitude uninterruptedly as set. One can also nevertheless design this reference source such that it is controllable with changeover signals and then delivers a set reference voltage U3 or respectively reference current I3 only by way of time, for example, during the absence of controlling changeover signals. For this, for example, at least one of the IG-FETs and/or at least one of the resistors connected with it, for example R1, RO (FIG. 6), of the two stages can be connected with a control input U1, U2 for the overlaying of a changeover control signal. In the case that a binary changeover signal is fed to the control input, the reference magnitude U3/J3 is circuited in and out from it. In the case that an analog changeover signal is fed to the control input, the reference magnitude is correspondingly modulated. In this case, the reference source serves as subsequently balancable source of modulation constant currents or constant voltages.

It will be apparent that many modifications and variations may be effected without departing from the scope of the novel concepts and teachings of the present invention.

I claim as my invention:

1. An integrated FET module comprising a reference source, a converter including said reference source and operative for converting from one of an analog signal and a digital signal, to the other, said converter including said reference source and other converter elements being located on the same FET module, said reference source, after being manufactured, being subsequently selectively and precisely adjustable to supply an output reference voltage value as required by said converter, said reference source having two separate stages for coupling with the same direct current supply voltage and each stage forming a series circuit comprising at least one IG-FET and at least one load resistor, means providing a tap between the one IG-FET and the one load resistor in each stage, said taps being free of a direct cross-connection to the control gate of said IG-FET of the other stage, at least one IG-FET of at least one of said stages including a memory gate which is applied at least partially between the controllable control gate and the channel region thereof, and which is surrounded on all sides by an insulator, and thus is floating in the electrical sense, said reference source, between said taps of said stages, providing a differential voltage of defined value, which is used as said output reference voltage value, at least said memory gate being chargeable electrically, with step by step altered charge quantities, by way of trial, subsequently after manufacturing said module so as to receive a precisely determined charge such that said output reference voltage thus, which occurs during an application of said direct current supply voltage, is precisely that required by said converter, said memory gate during subsequent operation of said converter storing said precisely determined charge.

2. An integrated FET module comprising a converter including a reference source and converter elements for converting from one of an analog signal and a digital signal to the other, said converter including said reference source and said converter elements being located on the same FET module, said reference source, after being manufactured, being subsequently selectively and precisely adjustable to supply an output reference magnitude, namely one of an output reference voltage value and an output reference current value as required by said converter, a common direct current supply source, said reference source having two separate stages each being supplied by said common direct current supply source and each forming a series circuit comprising at least one IG-FET and at east one load resistor, means providing a tap between the one IG-FET and the one load resistor in each stage, a differential amplifier, said taps being free of direct cross-connection to the control gate of said IG-FET of the other stage, but being connected to inputs of said differential amplifier, at least the one IG-FET of one of said stages including a memory gate which is applied at least partially between the controllable control gate and the channel region thereof, and which is surrounded on all sides by an insulator, and thus is floating in the electrical sense, said reference source, between said taps of said stages, providing a differential voltage which controls an output signal of said differential amplifier through said adjustment of said reference source; said output signal being said output reference magnitude, and at least said memory gate being chargeable electrically, with step by step altered charge quantities, by way of trial, subsequently after manufacturing said module so as to receive a precisely determined charge such that said output reference voltage value, which occurs during an application of said direct current supply voltage, is precisely that required by said converter, said memory gate during subsequent operation of said converter storing said precisely determined charge.

3. An integrated FET module according to claim 2, with a voltage divider characterized in that an output of said differential amplifier is connected with said voltage divider (R31/R32), the tap of which is connected with the control gate of said one IG-FET (F2) of the one of said two stages (F2/R2).

4. An integrated FET module according to claim 2, with first, second and third voltage dividers, characterized in that an output of said differential amplifier (DV) is connected with said first voltage divider (KR/KR), the tap of which is connected with the control gate of at least one of said IG-FETs (F1) of the first of said two stages (F1/R1), the same output of said differential amplifier (DV) is connected with said second voltage divider ($\alpha$R/RL), the first divider member of which ($\alpha$R) is connected directly with said same output of the differential amplifier (DV) and other divider member of which (RL) represents the load resistor (RL)

which is to be delivered with said output reference magnitude (I3), and the tap of said second voltage divider is connected with said third voltage divider $(1-\alpha)R/R$), the tap of which for its part is connected with the control gate of at least one of said IG-FETs (F2) of the second of said stages (F2/R2).

5. An integrated FET module according to claim 1 or 2, with a high ohmic resistance emitter follower resistor, characterized in that said two stages being connected in parallel such that both stages are in series with said emitter follower resistor (R0).

6. An integrated FET module according to claim 1 or 2, with contact connections on said integrated module characterized in that the electrodes of said IG-FET which contains said memory gate are connected with said contact connections (A1–A5) on the integrated module, which, after manufacturing said IG-FETs, are accessible by touching with a control voltage source for at least one of charging of said memory gate and testing of the charge quantities on said memory gate, before the encapsulation of said module.

* * * * *